US007037630B2

(12) United States Patent
Vong et al.

(10) Patent No.: US 7,037,630 B2
(45) **Date of Patent: *May 2, 2006**

(54) PHOTOCONDUCTIVE MEMBERS

(75) Inventors: Cuong Vong, Hamilton (CA); John F. Graham, Oakville (CA); Ah-Mee Hor, Mississauga (CA); James M. Duff, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/355,566

(22) Filed: Jan. 30, 2003

(65) Prior Publication Data

US 2004/0151996 A1 Aug. 5, 2004

(51) Int. Cl.
*G03G 5/06* (2006.01)

(52) U.S. Cl. ..... 430/56; 430/78; 430/72

(58) Field of Classification Search ..... 430/78, 430/56, 72

See application file for complete search history.

(56) References Cited

U.S. PATENT DOCUMENTS

| | | | | |
|---|---|---|---|---|
| 3,121,006 | A | 2/1964 | Middleton et al. | 96/1 |
| 3,357,989 | A | 12/1967 | Byrne et al. | 260/314.5 |
| 3,871,882 | A | 3/1975 | Wiedemann | 96/1.5 |
| 4,265,990 | A | 5/1981 | Stolka et al. | 430/59 |
| 4,555,463 | A | 11/1985 | Hor et al. | 430/59 |
| 4,587,189 | A | 5/1986 | Hor et al. | 430/59 |
| 5,336,577 | A | 8/1994 | Spiewak et al. | 430/59 |
| 5,473,064 | A | 12/1995 | Mayo et al. | 540/141 |
| 5,493,016 | A | 2/1996 | Burt et al. | 540/139 |
| 5,645,965 | A | 7/1997 | Duff et al. | 430/59 |
| 5,756,245 | A | 5/1998 | Esteghamatian et al. | 430/59 |
| 6,586,148 | B1 * | 7/2003 | Graham et al. | 430/58.65 |
| 6,656,650 | B1 * | 12/2003 | Lin et al. | 430/56 |
| 2002/0119385 | A1 * | 8/2002 | Azuma et al. | 430/78 |
| 2003/0211413 | A1 * | 11/2003 | Lin et al. | 430/78 |
| 2004/0018440 | A1 * | 1/2004 | Lin et al. | 430/78 |

FOREIGN PATENT DOCUMENTS

JP 2002055472 A * 2/2002

OTHER PUBLICATIONS

Borsenberger, Paul. et al. Organic Photoreceptors for Imaging Systems. New York: Marcel-Dekker, Inc. (1993) pp. 6-17, 190-195.*

Borsenberger, Paul M. Organic Photoreceptors for Imaging Systems. New York: Marcel-Dekker, Inc. (1993) pp. 190-191.*

* cited by examiner

*Primary Examiner*—Christopher Rodee
(74) *Attorney, Agent, or Firm*—Eugene O. Palazzo; Fay, Sharpe, Fagan, Minnich & McKee, LLP

(57) ABSTRACT

A photoconductive imaging member comprised of a supporting substrate, and thereover a single photoactive layer comprised of a mixture of a photogenerator component, an electron transport component, a transport component, and a polymeric binder; and wherein said photogenerating component is comprised of a mixture of a metal free phthalocyanine and a hydroxygallium phthalocyanine.

1 Claim, No Drawings

PHOTOCONDUCTIVE MEMBERS

RELATED PATENTS

Illustrated in U.S. Pat. No. 5,336,577, the disclosure of which is totally incorporated herein by reference, is a single layered photoconductive imaging member, and which layer contains certain charge generating components and certain charge transport components, and more specifically, an ambipolar photoresponsive device comprising a supporting substrate;

a single layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidene containing polymer.

Disclosed in U.S. Pat. No. 5,645,965, the disclosure of which is totally incorporated herein by reference, are photoconductive imaging members with perylenes and a number of charge transport molecules, such as amines.

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and thereover a charge transport layer.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f') diisoquinoline-6,11-dione and bisbenzimidazo(2,1-a:2',1'-a)anthra(2,1,9-def:6,5,10-d'e'f') diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution of, for example, from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

BACKGROUND

This invention is generally directed to imaging members, and more specifically, the present invention is directed to members comprised of a single bipolar photoconductive layer containing, for example, a mixture of charge generating components, or particles, and charge transporting components, such as charge transport molecules, electron transport components, and a binder, and wherein the charge generating components are sensitive, for example, to a wavelength of from about 400 to about 950 nanometers.

More specifically, the single bipolar layered photoconductive imaging members of the present invention can be selected for a number of different known imaging and printing processes including, for example, multicopy/fax devices, electrophotographic imaging processes, especially xerographic imaging and printing processes wherein negatively charged or positively charged images are rendered visible with toner compositions of an appropriate charge polarity. The imaging members as indicated herein are in embodiments sensitive in the wavelength region of, for example, from about 650 to about 950 nanometers, and in particular, from about 700 to about 850 nanometers, thus IR diode lasers can be selected as the light source. Moreover, the imaging members of the present invention can be selected for color xerographic imaging applications where several color printings can be achieved in a single pass.

The imaging member layer components, which can be dispersed in various suitable resin binders, can be of various thicknesses, however, in embodiments a thick layer, such as from about 5 to about 60 microns, and more specifically, from about 10 to about 40 microns, is selected. This layer can be considered a dual function layer since it can generate charges and transport charges over a wide distance, such as a distance of at least about 60 microns. Also, the presence of both the electron and hole transport components in the photoconductive layer can enhance mobility of both electrons and holes, and thus enable the imaging member to function with positive or negative charging conditions. As a result, the single bipolar photoconductive layer is capable of transporting both positive and negative charges rendering it more versatile than the photoconductive device with unipolar, either hole or electron, transport properties.

A number of electrophotographic imaging members are considered multi-layered imaging members comprising a substrate and a plurality of other layers such as a photogenerating layer and a charge transport layer. Typically, the charge transport layer contains one kind of charge transport components, either hole or electron transport molecules, and hence the member is unipolar and will operate under one type of charging process. Furthermore, the photogenerating layer tends to be very thin, about 1 micron or less, to allow photogenerated charges to be injected out promptly into the charge transport layer. The thin photogenerating layer is substantially incapable of fully absorbing imaging laser light leading to the formation of an interference pattern, namely "plywood", in the printed outputs. These multi-layered imaging members are, therefore, costly and time consuming to fabricate because of the many layers that must be formed. Further, complex equipment and valuable factory floor space are required to manufacture these multi-layered imaging members, and moreover, some of these members possess undesirable plywooding affects. The expression "plywood", refers in embodiments to the formation of unwanted patterns in electrostatic latent images caused by multiple reflections during laser exposure of a charged imaging member. When developed, these patterns resemble plywood.

Hence an additional anti-plywooding layer may be needed below the photogenerating layer to scatter the laser light to prevent the formation of plywood pattern. Various approaches are known to eliminate the plywood effect, such as roughening the substrate surface, introducing light scattering particles, and adding a light absorbing layer below the photogenerating layer.

The single bipolar photoconductive layer, which can be exposed to light of the appropriate wavelengths simultaneously, or sequentially, exhibits excellent cyclic stability, independent layer discharge, acceptable dark decay characteristics, excellent residual voltage, allows tuning of the electrical properties of the imaging member, excellent photosensitivity, and enables substantially no adverse changes in performance over extended time periods. Processes of imaging, especially xerographic imaging and printing, including digital, are also encompassed by the present invention.

Imaging members with single bipolar photoconductive layer possess a number of advantages as indicated herein, however, the complex interactions between photogenerating components, charge transport components and polymer matrix binder may impose constraints in the design of these members, especially with regard to optimizing the photosensitivity of the number for a particular application. In contrast, with the present invention in embodiments there is selected a mixture of two photogenerator pigments in single bipolar photoconductive layer, as a means for adjusting the photosensitivity of the imaging members over a wide range and achieving excellent predictability of the photosensitivity two pigments with different photosensitivities, for example one that is about 2.5 times more sensitive than the other, can be selected in embodiments of the present invention, for example a mixture of Type V hydroxygallium phthalocyanine and x-metal free phthalocyanine.

Thus, there remains a need for improving the color printing capability of xerographic processes, and in particular, to permit the printing of a number of colors with a minimum number of photoconductive passes, and therefore, for example, enhance the productivity of the printing process; and moreover, there is a need for single layer photoconductive imaging members with excellent photoconductor electricals and a wide range of photosensitivities.

These and other needs and advantages can be achievable with the photoconductive imaging members of the present invention in embodiments thereof.

REFERENCES

Processes for the preparation of x-metal free phthalocyanines are illustrated in U.S. Pat. No. 3,357,989 the disclosure of which is totally incorporated herein by reference.

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of certain perylene pigments as photoconductive substances is also known. There is thus disclosed in Hoechst European Patent Publication 0040402, DE3019326, the use of N,N'-disubstituted perylene-3,4,9,10-tetracarboxyldiimide pigments as photoconductive substances. Specifically, for example, there is disclosed in this publication N,N'-bis (3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the disclosure of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component as a hole transport layer.

Illustrated in U.S. Pat. No. 5,336,577, the disclosure of which is totally incorporated herein by reference, are single layered imaging members as indicated herein before.

The appropriate components and processes of the above prior art patents may be selected for the present invention in embodiments thereof.

SUMMARY OF THE INVENTION

It is a feature of the present invention to provide imaging members thereof with many of the advantages illustrated herein.

Another feature of the present invention relates to the provision of single bipolar layered photoresponsive imaging members with excellent photosensitivity to near infrared radiations.

It is yet another feature of the present invention to provide single bipolar layered photoresponsive imaging members with a sensitivity to visible light, and which members possess in embodiments tunable and preselected electricals, acceptable dark decay characteristics, and high photosensitivity, and wherein the mixture of photogenerating pigments enables in embodiments this combination of properties not fully achievable with a single comparative photogenerating pigment.

Moreover, another feature of the present invention relates to the provision of improved single bipolar layered photoresponsive imaging members with photosensitivity over a wide wavelength region of, for example from about 400 to about 950 nanometers.

It is yet another feature of the present invention to provide photoconductive imaging members with a single layer comprised of photogenerating components, electron and hole transport components.

In a further important feature of the present invention there are provided imaging members containing as one photogenerating pigment Type V hydroxygallium phthalocyanine, especially with XRPD peaks at, for example, Bragg angles (2 theta+/−0.2°) of 7.4, 9.8, 12.4, 16.2, 17.6, 18.4, 21.9, 23.9, 25.0, 28.1, and the highest peak at 7.4 degrees, and as a second pigment a metal free phthalocyanine having a photosensitivity, at least 50 percent, lower than Type V hydroxygallium phthalocyanine. The preferred metal free phthalocyanine is X-metal free phthalocyanine having major XRPD peaks, as measured with an X-ray diffractometer, at Bragg angles (2 theta+/−0.2°) of 7.6, 9.2, 16.8, 22.4, 28.6 degrees, and the two highest peaks at 7.4 and 9.2 degrees. The X-ray powder diffraction traces (XRPDs) were generated on a Philips X-Ray Powder Diffractometer Model 1710 using the radiation of CuK-alpha wavelength (0.1542 nanometer).

In still a further feature of the present invention there are provided photoresponsive, or photoconductive imaging members which can be selected for imaging processes including color xerography.

Aspects of the present invention relate to a photoconductive imaging member comprised of supporting substrate, and thereover a layer comprised of a photogenerator mixture of metal free phthalocyanine and hydroxygallium phthalocyanine components, electron and hole transport components; a member wherein the photogenerating layer is of a thickness of from about 5 to about 60 microns; a member wherein the amounts for each of the photogenerator components is from about 0.05 weight percent to about 10 weight percent, from about 5 weight percent to about 50 weight percent for the hole transport component, from about 5 weight percent to about 50 weight percent for the electron transport component, from about 30 to about 70 weight percent for the polymer binder, and wherein the total of the components is about 100 percent; a member wherein the amounts for each of the photogenerating components is from about 0.5 weight percent to about 5 weight percent, from about 10 weight percent to about 40 weight percent for the hole transport component, from about 10 weight percent to about 40 weight percent for the electron transport component, from about 30 weight percent to about 70 weight percent of a polymer binder, and the total of the components is about 100 percent; a member wherein the thickness of the single layer is from about 10 to about 40 microns; a member wherein the components are contained in a polymer binder, and wherein the charge transport is comprised of hole and electron transport molecules; a member wherein the hydroxygallium phthalocyanine and metal free phthalocyanine absorb light of a wavelength of from about 400 to about 950 nanometers; an imaging member wherein the supporting substrate is comprised of a conductive substrate comprised of a metal; an imaging member wherein the conductive substrate is aluminum, conductive plastic, aluminized polyethylene terephthalate or titanized polyethylene terephthalate; an imaging member wherein the binder is selected from the group consisting of polyesters, polyvinyl butyrals, polycarbonates, polystyrenes, polysiloxanes and polyacrylates; an imaging member wherein the charge, such as hole transport component, comprises aryl amine molecules; an imaging member wherein the hole transport is comprised of

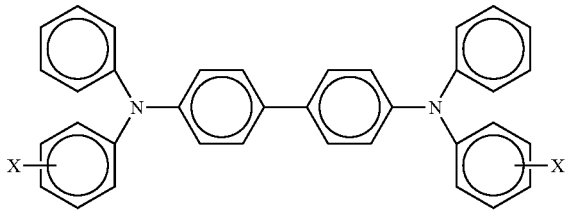

wherein X is selected from the group consisting of alkyl and halogen; an imaging member wherein alkyl contains from about 1 to about 10 carbon atoms, and wherein amine is optionally dispersed in a highly insulating and transparent resinous binder; an imaging member wherein alkyl contains from about 1 to about 5 carbon atoms; an imaging member wherein alkyl is methyl, and wherein halogen is chloro; an imaging member wherein the charge transport is comprised of N,N'-diphenyl-N,N-bis(3-methyl phenyl)-1,1'-biphenyl-4,4'-diamine; an imaging member wherein the electron transport component is selected from the group consisting of 9-fluorenylidene malononitrile represented by the structure

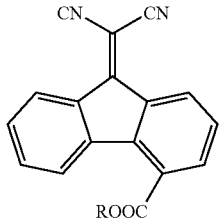

N,N'-bisalkyl-1,4,5,8-naphthalenetetracarboxylic dilmide represented by the structure

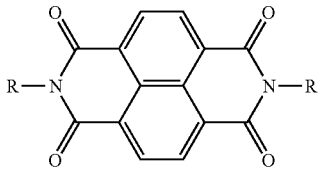

and diphenoquinone represented by

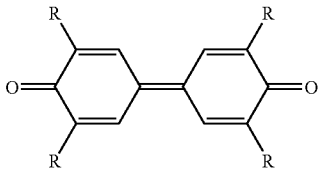

wherein R is alkyl with about 1 to about 30 carbon atoms or an aryl group with about 6 to about 30 carbon atoms; an imaging member wherein the photogenerating components are Type V hydroxygallium phthalocyanine and x-metal free phthalocyanine, the hole transport is N,N'-diphenyl-N,N-bis (3-methyl phenyl)-1,1'-biphenyl-4,4'-diamine molecule, and the electron transport is a N,N'-bisalkyl-1,4,5,8-naphthalenetetracarboxylic diimide, diphenoquinone or 9-fluorenylidene malononitrile; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 400 to about 950 nanometers; an imaging member further containing an adhesive layer; an imaging member further containing an adhesive layer and a charge blocking layer; an imaging member wherein the blocking layer is contained as a coating on a substrate and wherein the adhesive layer is coated on the blocking layer; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 400 to about 950 nanometers; an imaging member further containing an adhesive layer; an imaging member further containing an adhesive layer and a charge blocking layer; an imaging member wherein the blocking layer is contained as a coating on a substrate and wherein the adhesive layer is coated on the blocking layer; a method of imaging which comprises generating an electrostatic latent image on the imaging member of the present invention, developing the latent image, and transferring the developed electrostatic image to a suitable substrate; and a method of imaging which comprises generating an electrostatic latent image on the imaging member, developing the latent image, transferring and fixing the developed electrostatic image to a suitable substrate.

The bipolar photoresponsive imaging member of the present invention in embodiments is comprised, in the following sequence, of a supporting substrate, a single layer thereover comprised of a photogenerator layer comprised of Type V hydroxygallium phthalocyanine and x-metal free phthalocyanine, hole transport molecules of aryl amines, such as N,N'-diphenyl-N,N'-bis(3-methyl phenyl)-1,1'-biphenyl-4,4"-diamine, and electron transport molecules of N,N'-bisalkyl-1,4,5,8-naphthalenetetracarboxylic diimide, diphenoquinone or 9-fluorenylidene malononitrile, all preferably dispersed in a suitable polymer binder.

The photogenerating components and the charge transport components are preferably dispersed in a suitable binder, such as polycarbonates, polyesters, polyvinylbutaryl, polystyrenes, polyacrylate, polysiloxanes, and polyurethanes. The thickness of the single layer can be, for example, from about 5 microns to about 60 microns, and more specifically, from about 10 microns to about 40 microns.

The photogenerating pigments can be present in various amounts, such as, for example, from about 0.05 weight percent to about 10 weight percent for each pigment, and more specifically, from about 0.5 weight percent to about 5 weight percent. Charge transport components, such as hole and electron transport molecules, can be present in various effective amounts, such as in an amount of from about 5 weight percent to about 50 weight percent for each transport component, and more specifically, hole transport component in an amount of from about 10 weight percent to about 40 weight percent, and electron transport component in an amount of about 10 to about 40, and the polymer binder can be present in an amount of from about 30 weight percent to about 70 weight percent, and more specifically, in an amount of from about 30 weight percent to about 50 weight percent.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of hole and electron transport molecules, bipolar transport can be obtained, that is, the imaging member can be charged negatively or positively charged, and the member can also be photodischarged.

The photogenerating pigments selected for the single bipolar layer should have a significant difference in their photosensitivities, for example one is about 50 percent less sensitive than the other. For example, Type V hydroxygallium phthalocyanine is about 2.5 times more sensitive than x-metal free phthalocyanine, and a mixture of these two pigments at various ratios of from 5:95 to 95:5 of x-metal free phthalocyanine:Type V hydroxygallium phthalocyanine allows the adjustment of photosensitivity with $E_{1/2}$ values ranging from about 1.36 erg/cm$^2$ to about 3.24 erg/cm$^2$. ($E_{1/2}$ is the exposure energy required for 50 percent photodischarge and is commonly used to rate the photosensitivity of materials. Smaller $E_{1/2}$, means higher photosensitivity). The photosensitivity of the blended mixture of these two pigments can be preselected primarily because of the linear dependence relationship of the composition. For the blended pigment mixtures, the plot of photosensitivity values against the composition of pigment in terms of weight percent of either one of two pigments, show an excellent linear dependency with a regression coefficient $R^2$ approaching unity. For the pigment mixtures illustrated herein in embodiments, the coefficient $R^2$ can be as high as 0.99. Therefore, one can calculate the final sensitivity of pigment mixture, for instance when the photosensitivity of hydroxygallium phthalocyanine is $E_{1/2}$=xergs/cm$^2$ and metal free phthalocyanine is $E_{1/2}$=y ergs/cm$^2$, the final photosensitivity of a pigment mixture containing m weight percent of hydroxygallium phthalocyanine and n weight percent of metal free phthalocyanine, where the (m+n) amounts to the total pigment weight (100 percent), has a value of about $E_{1/2}$=(mx+ny)÷100 ergs/cm$^2$. The linear range of sensitivities can be fashioned by blending varying amounts of hydroxygallium phthalocyanine with metal free phthalocyanine.

Examples of preferred phthalocyanines are Type V hydroxygallium phthalocyanine and x-metal free phthalocyanine, and the like, such as a mixture of two phthalocyanines with dissimilar photosensitivities, examples of which are titanyl phthalocyanine and x-metal free phthalocyanine; chlorogallium phthalocyanine and x-metal free phthalocyanine; hydroxygallium phthalocyanine and copper phthalocyanine; titanyl phthalocyanine and copper phthalocyanine, chlorogallium phthalocyanine and copper phthalocyanine; vanadyl phthalocyanine and copper phthalocyanine, and the like.

Aryl amines selected as the hole transporting component include molecules of the following formula

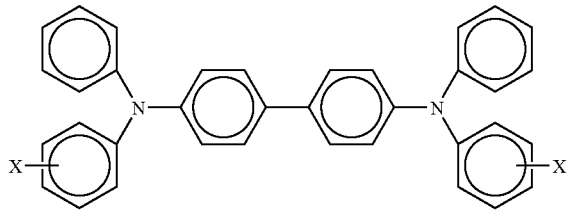

preferably dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of electron transporting component are selected from the group consisting of 9-fluorenylidene malononitrile represented by the structure

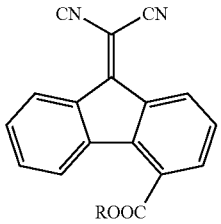

wherein R is alkyl or aryl, N,N'-bisalkyl-1,4,5,8-naphthalenetetracarboxylic diimide represented by the structure

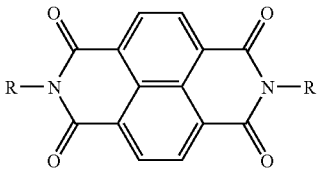

wherein R is alkyl or aryl, and diphenoquinone represented by the structure

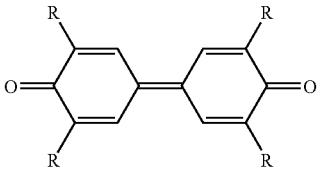

wherein R is, for example, alkyl or aryl.

Specific examples of 9-fluorenylidene malononitrile electron transport molecules are 4-butoxycarbonyl-9-fluorenylidene malonitrile, 4-pentoxycarbonyl-9-fluorenylidene malonitrile, 4-hexyloxycarbonyl-9-fluorenylidene malonitrile, or 4-(2-ethylhexyloxycarbonyl)-9-fluorenylidene malonitrile, and the like.

Specific examples of N,N'-bisalkyl-1,4,5,8-naphthalene tetracarboxylic diimide electron transport molecules are N,N'-bis(propyl)-1,4,5,8-naphthalenetetracarboxylic diimide, N,N'-bis(butyl)-1,4,5,8 -naphthalenetetracarboxylic diimide, N,N'-bis(pentyl)-1,4,5,8-naphthalenetetracarboxylic diimide, N,N'-bis(1,2-dimethylpropyl)-1,4,5,8-naphthalenetetracarboxylic diimide, or N,N'-bis(hexyl)-1,4,5,8-naphthalenetetracarboxylic diimide and the like.

Specific examples of diphenoquinone electron transport molecules are 3,3',5,5'-tetra-tert-butyldiphenoquinone, 3,3',5,5'-tetra-tert-methyldiphenoquinone, or 3,3',5,5'-tetra-tert-pentyldiphenoquinone, and the like.

Generally, the thickness of the single bipolar layer in contact with the supporting substrate depends on a number of factors, including the thicknesses of the substrate, and the amount of components contained in the single layer, and the like. Accordingly, the layer can be of a thickness of, for example, from about 5 microns to about 60 microns, and more specifically, from about 10 microns to about 40 microns. The maximum thickness of the layer in an embodiment is dependent primarily upon factors, such as photosensitivity, electrical properties and mechanical considerations. The binder resin present in various suitable amounts, for example from about 30 to about 70, and more specifically, from about 30 to about 70 weight percent, may be selected from a number of known polymers such as polyesters, polycarbonates, polysiloxanes, poly(vinyl chloride), polyacrylates and methacrylates, copolymers of vinyl chloride and vinyl acetate, phenoxy resins, polyurethanes, poly (vinyl alcohol), polyacrylonitrile, polystyrene, and the like. In embodiments of the present invention, it is desirable to select as the single layer coating solvents, such as ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Examples of substrate selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as, for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as MAKROLON®.

The thickness of the substrate depends on many factors, including economical considerations, thus this layer may be of substantial thickness, for example over 3,000 microns, or of a minimum thickness. In one embodiment, the thickness of this layer is from about 75 microns to about 300 microns.

There may also be selected for the members of the present invention a suitable adhesive layer, preferably situated between the substrate and the single layer, examples of adhesives being polyesters, such as VITEL® PE100 and PE200 available from Goodyear Chemicals, and polyamides, poly(vinyl butyral), poly(vinyl alcohol), polyurethane and polyacrylonitrile. This adhesive layer can be coated onto the supporting substrate from a suitable solvent, such as tetrahydrofuran and/or dichloromethane solution to enable a thickness thereof ranging, for example, from about 0.001 to about 5 microns, and more specifically, from about 0.1 to about 3 microns. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

The photoconductive imaging members can be economically prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating and charge transport components for the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours under stationary conditions or in an air flow. The coating can be accomplished to provide a final coating thickness of from about 0.01 to about 60 microns after drying. The fabrication conditions for a given photoconductive layer can be tailored to achieve optimum performance and cost in the final members. The coating of the layer with a mixture of photogenerating components, charge transport components and binder in embodiments of the present invention can also be accomplished with spray, dip or wire-bar methods such that the final dry thickness of layer is, for example, from about 5 to about 60 microns, and more specifically, from about 10 to about 40 microns after being dried at, for example, about 40° C. to about 150° C. for about 5 to about 90 minutes.

Imaging members of the present invention are useful in various electrostatographic imaging and printing systems, particularly those conventionally known as xerographic processes. Specifically, the imaging members of the present invention are useful in xerographic imaging processes wherein the photogenerating components like the Type V hydroxygallium phthalocyanine and x-metal free phthalocyanine pigments absorbs light of a wavelength of from about 400 to about 950 nanometers, and more specifically, from about 700 to about 850 nanometers. Moreover, the imaging members of the present invention can be selected for electronic printing processes with gallium arsenide diode lasers, light emitting diode (LED) arrays which typically function at wavelengths of from about 660 to about 830 nanometers.

Also, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example, by heat, the image thereto. In those environments wherein the member is to be used in a printing mode, the imaging method is similar with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. A comparative Example is also provided.

All XRPDs were determined as indicated herein, that is X-ray powder diffraction traces (XRPDs), were generated on a Philips X-Ray Powder Diffractometer Model 1710 using X-radiation of CuK-alpha wavelength (0.1542 nanometer).

EXAMPLE I

Fabrication and Xerographic Evaluation of Single Layer Photoresponsive Members:

Single layer photoresponsive imaging members of various compositions were fabricated with x-metal free phthalocyanine, hydroxygallium phthalocyanine (Type V), the electron transport bis(1,2-dimethylpropyl)-1,4,5,8-naphthalene tetracarboxylic diimide (NTDI), N,N'-diphenyl-N,N'-bis(3-methylphenyl)-1,1'-biphenyl-4,4'-diamine (TPD), and the binder polycarbonate PCZ (bisphenol Z polycarbonate, weight average molecular weight, $M_w$=60,000). Table A illustrates that only the relative weight ratio of HOGaPc and x-H2Pc was varied while other ingredients remained constant. The coating mixtures used to fabricate single layer photoresponsive members were prepared from two components, a pigment dispersion and charge transport solution. Pigment dispersions were prepared by roll milling 2.15 grams of pigment or the pigment mixture as shown in Table A, 2.15 grams of polycarbonate PCZ with 26.5 grams of tetrahydrofuran and 6.6 grams of chlorobenzene in a 120 milliliter glass bottle containing 280 grams of 0.125 inch stainless steel balls for 28 hours. A hole transport solution was prepared by dissolving 0.81 gram of bis(1,2-dimethylpropyl)-1,4,5,8-napthalene tetracarboxylic diimide (NTDI), an electron transporting molecule, 1.22 grams of N,N'-diphenyl-N,N'-bis(3 -methylphenyl)-1,1'-biphenyl-4,4'-diamine (TPD), a hole transport molecule, 1.86 grams of polycarbonate PCZ in 8.76 grams of tetrahydrofuran, and 2.19 grams of chlorobenzene in a capped bottle. To each charge transport solution was added 1.41 grams of the above pigment dispersion, and the coating mixture was roll milled overnight. The resulting mixture was drawbar coated onto aluminized MYLAR® conductive substrate using 10 mil bar gap. The device resulting was dried in an ambient environment overnight then transferred to a forced air oven at 115° C. for 60 minutes. The resulting imaging member was about 30 microns thick, and its photoconductive layer was composed of 2 percent pigment or pigment mixture, 20 percent electron transport molecules, 30 percent hole transport molecules and 48 percent polymer binder, all expressed in weight percentage.

TABLE A

| Imaging Member ID | Weight Ratio of HOGaPc:x-H2Pc | Amount of Pigment Used to Prepare Dispersion |
|---|---|---|
| 1A | 100:0 | 0.215 g HOGaPc |
| 1B | 75:25 | 0.161 g HOGaPc, 0.54 g x-$H_2$Pc |
| 1C | 50:50 | 0.1075 g HOGaPc, 0.1075 g x-$H_2$Pc |
| 1D | 25:75 | 0.54 g HOGaPc, 0.161 g x-$H_2$Pc |
| 1E | 0:100 | 0.215 g x-$H_2$Pc |

The xerographic electrical properties of each imaging member were then determined by electrostatically charging its surface with a positive corona discharging device until the surface potential, as measured by a capacitively coupled probe attached to an electrometer, attained an initial value $V_o$. After resting for 0.5 second in the dark, the charged member reached a surface potential of $V_{ddp}$, dark development potential, and was then exposed to light from a filtered xenon lamp. A reduction in the surface potential to $V_{bg}$, background potential due to photodischarge effect, was observed. Usually the dark decay in volt/second was calculated as $(V_o-V_{ddp})0.5$. The lower the dark decay value, the more favorable is the ability of the member to retain its charge prior to exposure by light. Similarly, the lower the $V_{ddp}$, the poorer is the charging behavior of the member. The percent photodischarge was calculated as 100 percent× $(V_{ddp}-V_{bg})/V_{ddp}$. The light energy used to photodischarge the imaging member during the exposure step was measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. Higher photosensitivity (lower $E_{1/2}$ value), lower dark decay, and high charging are desired for the improved performance of xerographic imaging members.

The following Table B summarizes the xerographic electrical results when the exposed light used was at a wavelength of 780 nanometers.

TABLE B

Xerographic Electricals of Single Layer Photoresponsive Members with NTDI

| Imaging Member ID | Weight Ratio of HOGaPc:x-$H_2$Pc | Dark Decay V/s | $E_{1/2}$ Erg/cm$^2$ |
|---|---|---|---|
| 1A | 100:0 | 53 | 1.36 |
| 1B | 75:25 | 54 | 1.66 |
| 1C | 50:50 | 51 | 2.10 |
| 1D | 25:75 | 51 | 2.63 |
| 1E | 0:100 | 45 | 3.24 |

The results in Table B indicate that the photosensitivity of single layer photoresponsive members can be varied by changing the relative composition of the two photogenerating pigments. Dark decay values remain fairly constant. A regression plot of $E_{1/2}$ values versus the pigment composition in weight percent shows an excellent linear correlation with $R^2$=0.9938 which refers to the regression coefficient; when $R^2$ approaches unity, the correlation between two experimental quantities, that is the weight percent of pigment and the photosensitivity $E_{1/2}$ show a linear dependence relationship. The maximum theoretical value is unity. This linearity allows an accurate prediction of final photosensitivity from the composition of pigment mixture.

EXAMPLE II

Another series of single layer photoresponsive imaging members were fabricated in accordance with Example I except that the NTDI was replaced by the electron transport molecule (4-n-butoxycarbonyl-9-fluorenylidene)malononitrile, BCFM. The xerographic evaluation was performed for these members and results are summarized in Table C.

TABLE C

Xerographic Electricals of Single Layer Photoresponsive Members with BCFM

| Imaging Member ID | Weight Ratio of HOGaPc:x-$H_2$Pc | Dark Decay V/s | $E_{1/2}$ Erg/cm$^2$ |
|---|---|---|---|
| 2A | 100:0 | 84 | 1.32 |
| 2B | 75:25 | 78 | 1.57 |
| 2C | 50:50 | 77 | 1.77 |
| 2D | 25:75 | 75 | 1.95 |
| 2E | 0:100 | 84 | 2.12 |

Though the replacement of NTDI by BCFM led to higher dark decay than in those of Table B, the variation of photosensitivity shows an excellent linear dependence on the pigment composition. A regression plot of $E_{1/2}$ versus pigment composition gives $R^2$=0.9849.

COMPARATIVE EXAMPLE 1

In this Comparative Example, a series of single layer photoresponsive imaging members were fabricated in accordance to Example I except that only one pigment, hydroxygallium phthalocyanine (Type V), is used. The amount of hydroxygallium phthalocyanine was varied from 0.215 gram to 0.108 gram to determine how much the photosensitivity could be altered. The devices fabricated and their xerographic evaluation result are summarized in Table D.

TABLE D

Xerographic Electricals of Single Layer Photoresponsive Members with Single Pigment HOGaPc

| Imaging Member ID | Relative Weight of Pigment with Respect to Device 1A | Amount of Pigment Used to Prepare Dispersion | Dark Decay V/s | $E_{1/2}$ Erg/cm$^2$ |
|---|---|---|---|---|
| 3A | 100 | 0.215 g HOGaPc | 53 | 1.36 |
| 3B | 75 | 0.161 g HOGaPc | 42 | 1.48 |
| 3C | 50 | 0.108 g HOGaPc | 36 | 1.62 |

The results illustrated that the variation of photosensitivity, in terms of $E_{1/2}$ values, was very limited, about 25 percent, from $E_{1/2}$ of 1.36 to 1.62 erg/cm$^2$ when reducing the pigment HOGaPc content from about 0.216 gram to about 0.108 gram. For comparison, when the devices contains a pigment mixture (imaging member 1A versus 1C), the variation of photosensitivity is about 54 percent from $E_{1/2}$ of 1.36 to 2.10 erg/cm$^2$ when the HOGaPc content was reduced in the amount of, for example, from about 0.216 to about 0.108 gram. This clearly illustrates that when using a pigment mixture the latitude in tuning photosensitivity is about 3 times larger. In the absence of a second pigment (x-metal free phthalocyanine), the photosensitivity of single layer photoreceptors has a much narrower range for adjustment.

COMPARATIVE EXAMPLE 2

In another Comparative Example, a series of single layer photoresponsive imaging members were fabricated in accordance with Example I except that only one pigment x-metal free phthalocyanine was used instead of a pigment mixture. The content of x-metal free phthalocyanine was varied from about 0.216 to about 0.648 gram to determine the extent the photosensitivity of single layer photoreceptors could be varied by increasing the content of pigment. The devices fabricated and their xerographic evaluation results are summarized in Table E.

TABLE E

Xerographic Electricals of Single Layer Photoresponsive Members with Single Pigment, x-Metal Free Phthalocyanine

| Imaging Member ID | Relative Weight of Pigment with Respect to Device 1E | Amount of Pigment Used to Prepare Dispersion | Dark Decay V/s | $E_{1/2}$ Erg/cm$^2$ |
|---|---|---|---|---|
| 4A | 100 | 0.215 g x-$H_2$Pc | 45 | 3.24 |
| 4B | 200 | 0.430 g x-$H_2$Pc | 38 | 3.42 |
| 4C | 300 | 0.645 g x-$H_2$Pc | 58 | 3.11 |

The results illustrated that the photosensitivity of photoreceptors could be slightly altered within less than 6 percent even when the pigment content was vastly increased by 200 percent. The devices in Example I showed that adding HOGaPc to x-metal free phthalocyanine in the single layer devices, the photosensitivity can be varied from $E_{1/2}$ value of 3.24 erg/cm$^2$ to 1.66 erg/cm$^2$, about 95 percent, when the HOGaPc content was increased from 0 to about 0.161 gram. This again clearly indicates the merit of using a pigment mixture for adjusting the photosensitivity of single layer photoreceptors rather than relying on a single pigment.

EXAMPLE III

The xerographic electricals of photoresponsive members in Example I were also evaluated under negatively charging conditions. The measuring conditions were identical to those described in Example I except that the corona device was now negatively charged. The xerographic evaluation results are summarized in Table F.

TABLE F

Xerographic Electricals of Single Layer Photoresponsive Members Under Negative Corona Charging

| Imaging Member ID | Weight Ratio of HOGaPc:x-$H_2$Pc | Dark Decay V/s | $E_{1/2}$ Erg/cm$^2$ |
|---|---|---|---|
| 1A | 100:0 | 56 | 4.24 |
| 1B | 75:25 | 49 | 6.02 |
| 1C | 50:50 | 54 | 9.47 |
| 1D | 25:75 | 61 | 13.7 |
| 1E | 0:100 | 66 | 17 |

The single layer photoreceptors of this invention can also function under negative charging conditions, and hence they are bipolar. However, the photosensitivities under negative charging conditions were relatively lower than those measured under positive charging shown in Example I. A regression plot of $E_{1/2}$ versus pigment composition gives $R^2$=0.9846 indicating that the variation of photosensitivity shows a linear dependence on the pigment composition. The excellent linearity of the plot allows an accurate prediction of final photosensitivity from the composition of pigment mixture.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a supporting substrate, and thereover a single photoactive layer comprised of a mixture of photogenerator components, an electron transport component, a hole transport component, and a polymeric binder; and wherein said photogenerator components are x-metal free phthalocyanine and Type V hydroxygallium phthalocyanine, the hole transport component is N,N'-diphenyl-N,N'-bis(3-methyl phenyl)-1,1'-biphenyl-4,4'-diamine, and the electron transport component is 4-(2-ethylhexyloxycarbonyl)-9-fluorenylidene malonitrile.

* * * * *